US005536227A

United States Patent [19]

Polchek et al.

[11] Patent Number: 5,536,227

[45] Date of Patent: Jul. 16, 1996

[54] BAR FOR USE IN THERAPEUTIC EXERCISE ACTIVITIES

[76] Inventors: Mary L. Polchek; Charles J. Polchek, both of 1101 Forest Harbor Dr., Hendersonville, Tenn. 37075

[21] Appl. No.: 285,177

[22] Filed: Aug. 3, 1994

[51] Int. Cl.[6] ..... A63B 21/065; A63B 21/075

[52] U.S. Cl. ..... 482/93; 482/107; 482/106

[58] Field of Search ..... 482/106, 107, 482/108, 109, 93, 139; 273/193 A, 67 DB, 194 B

[56] References Cited

U.S. PATENT DOCUMENTS

| | | | |
|---|---|---|---|
| 708,313 | 9/1902 | Buck | 482/108 |
| 793,101 | 6/1905 | Schmidt | 482/108 |
| 2,209,465 | 7/1940 | Matysek | 128/57 |
| 3,588,102 | 6/1971 | Gifford | 272/81 |
| 3,756,597 | 9/1973 | Monti | 272/81 |
| 4,043,553 | 8/1977 | Suarez | 272/128 |
| 4,440,391 | 4/1984 | Saenz, Jr. et al. | 272/93 |
| 4,623,146 | 11/1986 | Jackson | 272/137 |
| 4,722,523 | 2/1988 | Yang | 482/106 |
| 5,033,740 | 7/1991 | Schwartz et al. | 482/108 |
| 5,125,649 | 6/1992 | Fuller | 482/123 |

OTHER PUBLICATIONS

Smith & Rolyan, Inc., Product Catalog, 1994, pp. 1–5.

*Primary Examiner*—Stephen R. Crow

*Attorney, Agent, or Firm*—Waddey & Patterson; I. C. Waddey, Jr.

[57] ABSTRACT

The present invention discloses an elongated bar having a right section and a left section releasably attached to one another. Opposed rounds slidably and frictionally receive the elongated bar. A weight can then be placed between the two rounds to keep the weight in the middle of the bar to prevent the user's hands and wrists from being injured. Handle members are placed on the distal ends of the bar which provide an outer grip and an inner grip. The entire device can be easily taken apart for cleaning which is necessary after each use by an elderly or infirm person.

9 Claims, 1 Drawing Sheet

BAR FOR USE IN THERAPEUTIC EXERCISE ACTIVITIES

BACKGROUND OF THE INVENTION

The present invention relates generally to an exercise device and more particularly to a device that maintains the location of weight on and allows easy handling of an exercise bar.

It will be appreciated by those skilled in the art that physical therapy is an extremely important part of care for the elderly. However, in many cases, the elderly or infirm have little interest in such activities and are difficult to motivate. Further, care must be taken so that the activities do not do more harm than good. One typical activity is a range of motion exercise which the therapist uses to increase the patient's flexibility, strength and mobility. This exercise requires the patient to lift their arms or legs, rotate the arms or legs and pull against resistive pressure. In practice, therapist often use a broom, broom handle, or stick for the patient to grip while performing these type of exercises. As the patient grows stronger, the therapist will hold the broom, etc. and increase the resistive pressure experienced by the patient. However, there is a need to have a device designed specifically to assist the therapist is this procedure. There are numerous barbell type devices on the market and disclosed in the prior art, but none of them meet the needs of therapist adequately in assisting with these type exercises.

The state of the art is generally described in U.S. Pat. Nos. 2,209,465 issued to A. Matysek, 3,588,102 issued to L. Gifford, 3,756,597 issued to L. Monti, 4,043,553 issued to R. Suarez, 4,440,391 issued to A. Saenz, Jr., et al., 4,623,146 issued to B. Jackson, 5,125,649 issued to C. Fuller.

Specifically, U.S. Pat. No. 3,588,102 issued to L. Gifford on Jun. 28, 1971 discloses two outer bars each connected to an inner section. This allows the length of the rod to be adjusted. However, this device fails to recognize the need to limit the weight of the bar to the middle, to visually color the device so that it is interesting to the elderly or infirm, and to provide for easy cleaning and having dual handles to provide for an outer and inner grip.

U.S. Pat. No. 3,756,597 issued to L. Monti on Sep. 4, 1973 discloses another attempt. However, the Monti device also places the weight on the outer extremes. Further, the users are encouraged to use only one style of grip because of placement of handles. Also, Monti fails to recognize the need to make the device visually interesting.

Accordingly, one object of the present invention is to provide a device which is easily taken apart for cleaning. This needed device must prevent the user's hands from being injured. This needed device must be capable of placing weight in the middle of the bar for easy balance. This needed device should encourage both an outer and inner grip. This needed device must be visually interesting. This needed device must have soft round surfaces to prevent injury to the user. This needed device is presently lacking in the prior art.

SUMMARY OF THE INVENTION

The present invention discloses an elongated bar having a right section and a left section releasably attached to one another. Opposed rounds slidably and frictionally receive the elongated bar. A weight can then be placed between the two rounds to keep the weight in the middle of the bar to prevent the user's hands and wrists from being injured and to provide balance. Handle members are placed on the distal ends of the bar which provide an outer grip and an inner grip. The entire device can be easily taken apart for cleaning which is necessary after each use by an elderly or infirm person, particularly when the device is used by a therapist in a hospital or nursing home setting for therapy with numerous patients.

Accordingly, one object of the present invention is to provide an exercise device that can be used by an elderly or infirm person.

Another object of the present invention is to maintain the weight in the middle of the bar.

A still further object of the present invention is to provide a device which is brightly colored so that it is visually interesting.

A still further object of the present invention is to provide handles which direct the attention of the user to use an outer grip or an inner grip and provides flexibility to provide both without changing the location of the handles.

DESCRIPTION OF THE PREFERRED EMBODIMENT

Figure 1:
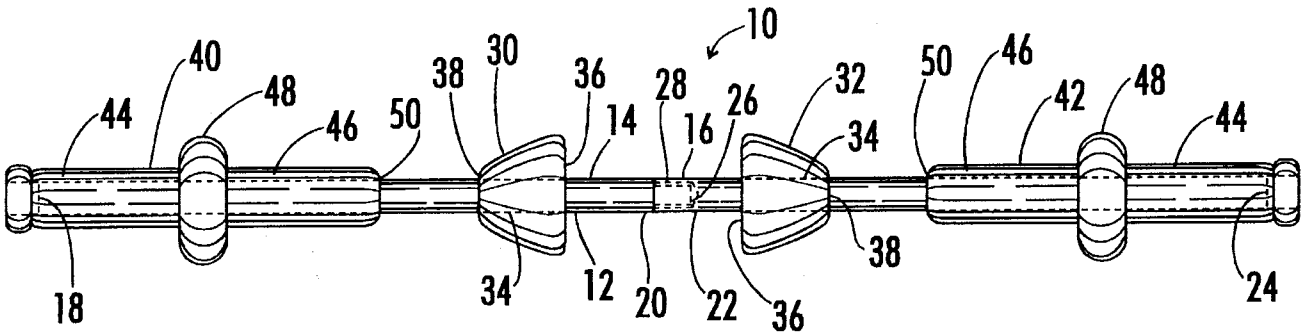
FIG. 1 is a plan view of the device of the present invention.

Referring now to FIG. 1 there is shown generally at 10 the device for use in connection with therapeutic exercise of the present invention. Device 10 is made of elongated bar 12 having left section 14 and right section 16. Left section 14 has left distal end 18 and left connecting end 20. Similarly, right section 16 has right connecting end 22 and right distal end 24. In the preferred embodiment, left distal end 16 has male end 26 whereas right connecting end 22 has female end 28. In the preferred embodiment, female end 28 and male end 26 have opposed threads. However, frictional attachment can be provided or the bar 12 can be an integral, single piece construction.

Placed on bar 12, there is left opposed round 30 and right opposed round 32. Opposed rounds 30, 32 have orifices 34 which slidably and frictionally receive bar 32. Rounds 30, 32 have large ends 36 and small ends 38. In the preferred embodiment, rounds 30, 32 are placed on bar 12 such that large ends 36 face one another and small ends 38 are away from one another.

Left handle member 40 and right handle member 42 slidably and frictionally receive bar 12 proximate to respective distal ends 18, 24. In the preferred embodiment, each handle member has outer handle 44 and inner handle 46 joined by spacer 48. Although either handle members 40, 42 can be made of separate pieces, in the preferred embodiment, handle members 40, 42 are molded in unitary construction so that they are easily cleaned and do not have unnecessary crevices to harbor contaminants. Handle members 40, 42 each have holes 50 which receive elongated bar 12. In the preferred embodiment, device 10 is brightly colored to excite the visual perception of the user.

Figure 2:
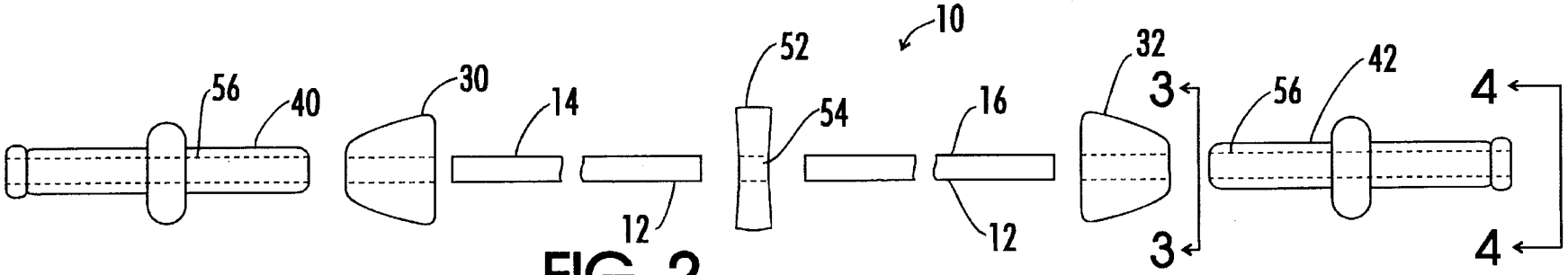
FIG. 2 is an exploded view of the device of the present invention.

Referring now to FIG. 2, one can see better how device 10 is separated for cleaning and use. For sake of discussion, applicant will use FIG. 2 to show how device 10 is actually put together. Initially, weight 52 having opening 54 is slid over elongated bar 12 either before or after left section 14 is attached to right section 16. Left opposed round 30 is placed on left section 14 whereas right opposed round 32 is attached to right section 16 to keep weight 52 from sliding along elongated bar 12. Rounds 30, 32 are preferably made of rubber, foam or similar "stretchable" material with each have orifice 34 of a diameter slightly smaller than the outside diameter of elongated bar 12. Thus, rounds 30, 32 slidably and frictionally receive bar 12. After rounds 30 32 are positioned, left handle member 40 is attached to left section 14 and right handle member 42 is attached to right section 16. Handle member 40, 42 are also constructed from an elastic type material and have holes 56 slightly smaller in diameter than elongated bar 12 so that handle members 40, 42 releasably and frictionally attach to bar 12.

In the preferred embodiment, weight 52 is a soft, flexible sleeve filled with granular weighting material and having hook and loop attachment pads ("Velcro") on each end so that the weight 52 can be attached to and removed from bar 12 without separating left section 14 and right section 16. Further, if a donut weight is used, only left section 14 or right section 16 need to be removed if weight 52 is changed. The remaining portions of device 10 can remain.

Figure 3:
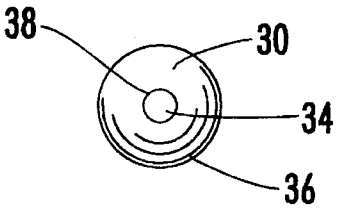
FIG. 3 is a side view of one of the exposed rounds of the present invention.

Referring now to FIG. 3, there is shown generally at 30 one of the opposed rounds of the present invention. For sake of discussion, opposed rounds 30, 32 are mirror images of one another and are interchangeable. In the preferred embodiment, as is discussed above in connection with FIG. 1, round 30 has orifice 34 running from large end 36 to small end 38.

Figure 4:
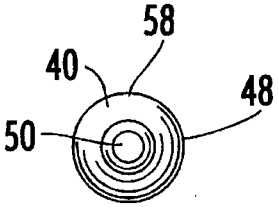
FIG. 4 is a side view of the handle member of the present invention.

Similarly, FIG. 4 shows generally at 40 the handle member of the present invention. Right handle member 42 is interchangeable with left handle member 40. Handle member 40 has spacer 48 separating inner handle 46 and outer handle 44 as shown in FIG. 1. Knob 58 protects user's hand from falling off the outer handle 44. Hole 50 runs through outer handle member 40 to frictionally and releasably receive bar 12.

In use, the device 10 will be gripped in the center by the therapist and handed to the patient, who will be directed to grasp the device at either end. The therapist will then maneuver the device 10 in a range of motion exercises with the patient holding onto the device. Thus, flexibility of the patient will be developed, and with time, the patient's strength will be increased. As the patient's strength increases, weight will be added to the center of the device. Because the device 10 is brightly colored, the patient will be attracted to the device and the patient's interest in the exercise will be increased. Once the exercise activities with one patient are completed, the therapist will move to the next patient for a similar series of exercises. If the next patient is not at the same level of strength as the former patient, the weight of the device can be easily adjusted. Also, if one patient has a communicable disease, the device can be easily cleaned and disinfected between uses because the various elements of the device can be dissembled for cleaning and disinfecting and re-assembled with minimal expenditure of time and effort.

Thus, although there have been described particular embodiments of the present invention of a new and useful bar for use in therapeutic exercise activities, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A device for use in connection with therapeutic exercise activities comprising:

a. an elongated bar having opposing end;

b. a pair of opposed rounds having an orifice for releasably and frictionally receiving said elongated bar, said rounds being constructed from a flexible material which will stretch under pressure; and c. a left handle and a right handle each having a hole therethrough and each releasably and frictionally receiving said elongated bar through said holes, each of said handles having an inner member joined to an outer member by a spacer, said respective handles attached to said elongated bar proximate said opposing ends.

2. The bar of claim 1 wherein said opposed rounds are brightly colored to excite the visual perception of a user.

3. The bar of claim 1 wherein said handles are brightly colored to excite the visual perception of a user.

4. The bar of claim 1 wherein said handles and said opposed rounds are colored to excite the visual perception of a user.

5. An exercise device comprising:

a. an elongated bar having a right section and a left section, said right section having a right distal end and a right connection end, said right connection end having a male end, said left section having a left distal end and a left connecting end having a female end, said male end releasably received by said female end;

b. a right stretachable round and a left stretchable round each having an orifice for releasably receiving said elongated bar, said right round releasably receiving said right section and said left round releasably receiving said left section;

c. a weight releasably attached to said elongated bar between said right round and said left round; and d. a left handle and a right handle each releasably received by said elongated bar by a respective hole, each of said handles having an inner handle member joined to an outer handle member by a spacer thereby allowing a patient to grasp either said outer handle members or said inner handles members, said left handle releasably attached proximate said left distal end and said right handle releasably attached proximate said right distal end.

6. The device of claim 5 wherein said opposed rounds are colored to excite the visual perception of a user.

7. The device of claim 5 wherein said handles are colored to excite the visual perception of a user.

8. The device of claim 5 wherein said handles and said opposed rounds are colored to excite the visual perception of a user.

9. The device of claim 5 wherein said elongated bar is stainless steel or plastic coated steel tubing.

* * * * *